United States Patent [19]

Jordan

[11] 4,024,734

[45] May 24, 1977

[54] YARN FAULT DETECTORS

[75] Inventor: Kenneth Albert Jordan, Oadby, England

[73] Assignee: Trip-Lite Ltd., Leicester, Great Britain

[22] Filed: Aug. 15, 1975

[21] Appl. No.: 605,368

[30] Foreign Application Priority Data

Oct. 9, 1974 United Kingdom ..... 43652/74
Oct. 9, 1974 United Kingdom ..... 43653/74

[52] U.S. Cl. ..... 66/158; 28/51; 28/64; 200/61.14; 318/6

[51] Int. Cl.[2] ..... B65H 63/02; D04B 35/18

[58] Field of Search ..... 66/157, 158; 57/80; 28/64, 51; 200/61.14, 61.13; 318/6; 73/160; 28/225

[56] References Cited

UNITED STATES PATENTS

| | | | |
|---|---|---|---|
| 2,172,128 | 9/1939 | Mitschele | 66/158 |
| 3,482,420 | 12/1969 | Bourgeois | 66/158 |
| 3,571,680 | 3/1971 | Tellerman et al. | 66/157 X |
| 3,689,963 | 9/1972 | Frei | 66/157 X |
| 3,918,275 | 11/1975 | Paepke | 66/158 X |

*Primary Examiner*—Louis K. Rimrodt
*Attorney, Agent, or Firm*—Burgess, Dinklage & Sprung

[57] ABSTRACT

A yarn fault detector suitable for mounting on a main frame of a knitting machine or on a side creel. The detector has two yarn guides on a guide frame that is biased to an operative yarn guiding position but movable overcenter to a yarn releasing position. End portions of a freely pivotable stop bar contact the yarn guides in the operative position of the guide frame to assure adequate contact with both guides. A variable bias is applied to the guide frame by means of a loop of flexible material on a rotary shaft, and a spring under tension between the loop and an eccentric cranked portion of the guide frame, the tension being dependent on the length of the loop wrapped around the shaft by rotation of the shaft. The loop and shaft are made by a one-piece moulding operation.

13 Claims, 4 Drawing Figures

YARN FAULT DETECTORS

The invention relates to yarn fault detectors, sometimes known as "top detectors," for detecting breaks and excessive tensions in yarns supplied to textile machinery such as knitting machines, from creels mounted at the top of such machines. Such detectors include lightweight pivotally mounted detector wires which rest on a yarn passing over a pair of guides and which, when the yarn breaks, fall to complete an electrical circuit for actuating a stop motion relay to stop the machine. Excessive tensions in the yarn would on the creel are detected by pivotally mounting the guides and urging then to an operative yarn guiding position by means of an overcentre device. The top detector in use is positioned so that any tension in the yarn passing from the creel and over the guides to the machine tends to urge the guides to move overcentre to a yarn releasing position, in which case the detector wire falls to complete the circuit for the stopmotion relay as above. The guides are generally provided with ceramic guiding surfaces on a wire frame, and the bias urging the guides overcentre to the operative yarn guiding position is preferably variable.

One problem that has been experienced when using such detectors is that when there is rapid decrease in the rate of demand for yarn by the machine, the yarn passing from the creel to the top detector tends to overshoot the guides and the resulting slackening of the yarn can cause the yarn to become wrapped around the guide nearer the creel rather than passing smoothly over it. It has been proposed to avoid this occurrence by causing the guide nearer the creel to contact a lug on the frame of the top detector, so that there is no space between the guide and lug to permit the yarn to depart from its intended path. The provision of one such lug is perfectly satisfactory when the top detector is designed soley for mounting on the frame for the machine. It is however desirable for the top detectors to be mountable optionally on side creels or on the frame of the machine, using the same snap-on fitment at one side of the top detector for both mountings. When the top detectors are designed in this way it is found that the direction of yarn travel is reversed when the detector is turned round and mounted on a side creel, relative to that when it is mounted on the frame of the machine. Thus the lug referred to above is no longer associated with the guide nearer the creel, and it is necessary to provide an additional lug for cooperation with the other of the guides. The disadvantage of such a construction is that it is very rare for the guides both firmly to contact their associated lugs at all times. What in fact happens is that the frame mounting the guides is not quite in alignment with the plane of the lugs, so that only one of the guides is in contact with its associated lug. This tendency is much more pronounced when the tension biasing the guides upwardly to their operative positions is very light. If only the guide remote from the creel is firmly in contact with its associated lug, the yarn can become wrapped around the above guide in precisely the manner indicated above.

Another problem associated with such fault detectors is the difficulty of producing a variable bias on the guide frames. In the past the coil springs in such fault detectors have been tensioned by engaging one end of the spring in a U-loop of filament the free ends of which are entrapped in the central split of a cotter pin. A knob is mounted on an end of the cotter pin by means of a grub screw, and turning of the knob causes the filament to wrap around the cotter pin, thus shortening the length of filament between the cotter pin and spring and extending the spring so as to increase its tension. There are problems in assembling and using such a device. Assembly is difficult as the free ends of the U-loop of filament have to be inserted in the split of the cotter pin. Generally this is made easier by first heat-welding the free ends to one another, but this in itself is a time-consuming operation. When assembled, the device has to be set to provide an appropriate mimimum or maximum tension to the spring so as to provide meaning to calibrations on the knob. This is achieved by gripping the bent-over end of the cotter pin with pliers and turning the pin until the desired reference (maximum or minimum) tension is obtained, and then tightening the grub screw to fix the knob on the opposite end of the cotter pin with the knob in the desired angular condition. This too is a time-consuming operation.

OBJECTS OF THE INVENTION

It is the object of the present invention to provide a top detector which avoids the above problems of entanglement of the yarn in the yarn guides.

It isa further object of the present invention to provide a top detector of simple and economical construction in which the bias on the guide frame can be easily adjusted.

It is a further object of the present invention to provide a top detector in which the calibration of the bias on the guide frame can be re-zeroed in a simple and rapid manner.

Other objects will become apparent from the following description.

SUMMARY OF THE INVENTION

The invention provides a yarn fault detector for textile machinery, comprising a housing, detector wire means pivotally mounted on said housing, a pivotable guide frame pivotally mounted on said housing and movable overcentre between an operative yarn guiding position and a yarn releasing position, means within said housing biasing said guide frame to its yarn guiding or releasing positions, a pair of yarn guides on said guide frame, a fixed guard frame having side guards, one at each side of said pair of yarns guides, extending from said guide frame for further guiding yarn through the detector and, a freely pivotable stop bar on said fixed guard frame for contacting both of said yarn guides when said guide frame is in its operative position.

Because the yarn guides contact a freely pivotable stop bar rather than fixed lugs, there is always good contact between the guides and the stop bar sufficient to prevent the yarn from passing therebetween, irrespective of the direction of passage of the yarn. When the pivotal axis of the stop bar is midway between the yarn guides, the force opposing the bias urging the guide frame to its operative position is shared equally between the two guides.

The guides are preferably ceramic guides on a wire pivotable guide frame. The stop bar may be mounted by any desired means, such by a pivot pin or by having its ends freely slidable in slots in a frame of the top detector and its mid portion engageable with a fulcrum when the guide frame biases the stop bar thereagainst. The stop bar may be of any desired cross-section.

The invention also provides a yarn fault detector for textile machinery, comprising a housing, detector wire means pivotally mounted on said housing, a pivotable guide frame pivotally mounted on said housing and movable overcentre between an operative yarn guiding position and a yarn releasing position, a one-piece moulding of a resilient plastics material having an integral loop portion and a shaft portion and being rotatably mounted within said housing, a control knob externally of said housing, associated with said one-piece moulding for effecting rotation thereof, a cranked portion of said guide frame internally of said housing, and resilient means between said cranked guide frame portion and said loop portion for biasing said guide frame towards its yarn guiding and releasing conditions with a bias that is dependent on the amount of said loop portion that is wrapped around said shaft portion. In use, the guide frame is biased to its operative position with a bias that may be varied by rotating the rotary shaft to wrap more or less of the flexible loop thereon. The loop portion is advantageously pre-stretched to reduce its tendency to creep. The rotary shaft may be rotatable by means of a knob splined to the shaft and removable axially, so that the knob can be removed axially, turned to any desired angular orientation and pushed back onto or into the shaft. This facilitates rapid setting of the knob to a given reference position of maximum or minimum tension.

Preferably the rotary shaft is made from a resilient plastics material such as nylon and also comprises an integral serrated disc the serrations of which are adapted in use to ride over a projection, such as a ridge or dimple, to give a resistance to turning.

The invention is illustrated by the accompanying drawings of which:

Figure 1:
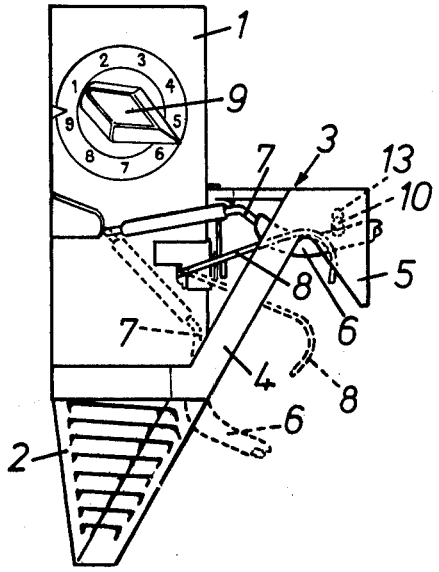
FIG. 1 is a side elevation of a top detector according to this invention.
Figure 2:
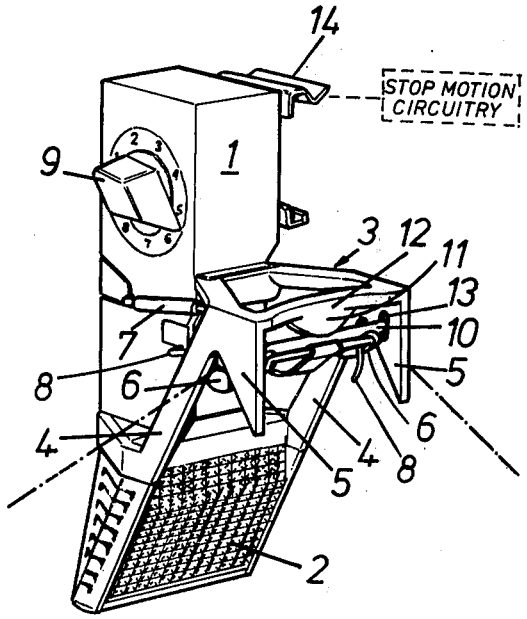
FIG. 2 is a perspective view of the top detector of FIG. 1 from the front and one side.

The top detector of FIG. 1 and 2 comprises a body 1 housing the electrical connections and components of the detector and a detector lamp in a translucent lamp housing 2. A guard frame 3 is formed from a one-piece plastics moulding and comprises side guards 4 each having downwardly directed front nib portions 5 behind which yarn is intended to pass in use. The intended yarn route is shown in dot-dash lines in FIG. 2 as being behind the nib portions 5, over a pair of ceramic guides 6 cemented on a wire guide frame 7 and under a pair of lightweight detector wires 8.

The guide frame 7 is biased upwardly to the operative position shown in full lines in FIGS. 1 and 2, the biasing force being variable by means of a control knob 9. The guide frame 7 is also movable overcentre with a snap action to the inoperative position shown in broken lines in FIG. 1 when the yarn passing over the ceramic guides 6 is at an excessive tension sufficient to overcome the biasing force on the guide frame. In this position of the guide frame 7 the detector wires 8 are no longer supported by the yarn and the stopmotion relay associated with the top detector is actuated.

Figure 3:
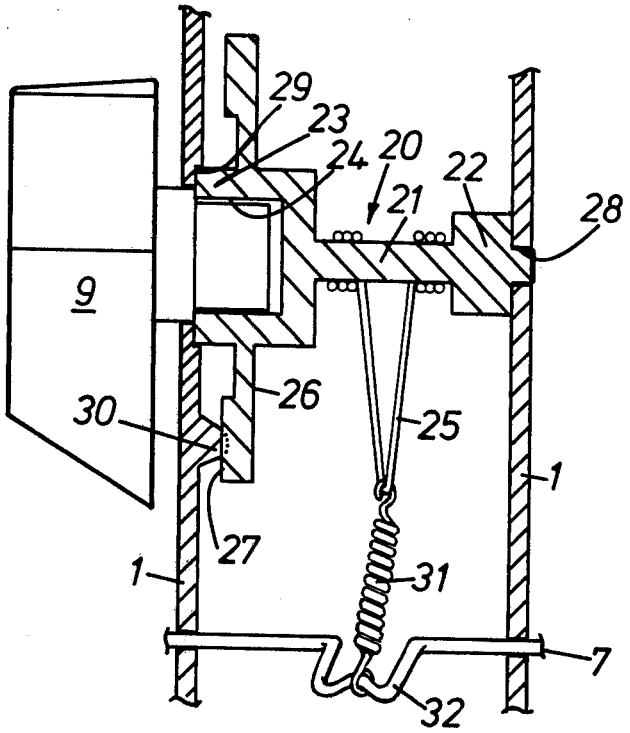
FIG. 3 is a section through a part of the top detector of FIG. 1, showing a mechanism for applying a variable bias to the guide frame of the top detector.
Figure 4:
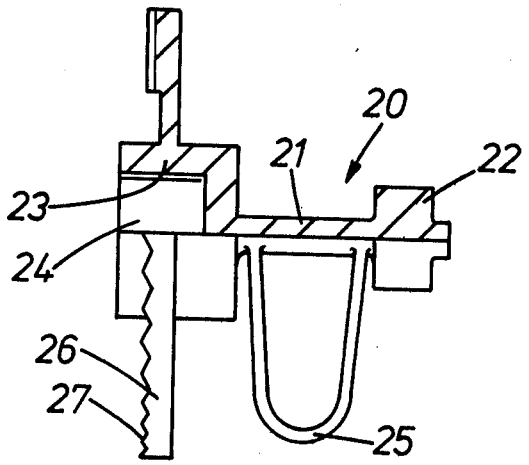
FIG. 4 is an elevation, partly in section, of a one-piece plastics moulding forming a substantial part of the mechanism of FIG. 3.

The mechanism for moving the guide frame 7 overcentre and for varying the bias on the frame 7 by means of the control knob 9 is shown in FIG. 3. The mechanism comprises a one-piece plastics moulding 20 (shown in greater detail in FIG. 4) which comprises a central stem portion 21 having at one end thereof a cylindrical shoulder 22 and at the other end a control knob mounting portion 23 having an internally splined cylindrical recess 24 therein for receiving a splined stem of the control knob 9. A moulded loop 25 is formed extending from the shaft portion 21 and is intergal with the remainder of the moulding. Around the mounting portion 23 is integrally formed an annular disc 26 one face of which is formed with a number of serration 27.

After its formation by a moulding process, the loop 25 is elongated to its elastic limit by applying a load thereto. In the embodiment described, the loop 5 is capable of withstanding a 16 lb. load, and has been elongated for example by a 12 lb. load.

The moulding 20 is snap-fitted as shown in FIG. 3 into bearing recesses 28 and 29 of the housing 1, with the cylindrical shoulder 22 and a cylindrical bearing portion of the mounting portion 23 received in opposite cylindrical bearing recesses 28 and 29 respectively. A projection 30 formed on the internal wall of the housing 1 engages the serrations 27 on the face of the annular disc 26 to restrict the free rotation of the moulding 20, but as the moulding is made from a resilient plastics material it can be forcibly rotated accompanied by appropriate intermittent deformation of the annular disc 26.

The extended loop 25 in the assembled construction is made to engage one end of a coil spring 31, the other end of which engages an eccentric cranked portion 32 of a shaft forming the pivotal axis of the guide frame 7. The desired minimum tension is applied to the spring 31 by rotating the knob 9 so as to wind the extended loop 25 around the stem portion 21 until all slack is taken up from the extended loop. The knob 9 is then removed axially, turned until it is in the configuration corresponding to minimum tension and replaced axially. Thereafter turning of the knob increases the tension in the spring 31 by the amount indicated on a scale printed upon the outside of the housing 1.

The formation of the cranked portion 32 of the guide frame 7 is such that as the frame 7 is pivotally moved between the two angular configurations shown in FIG. 1, the spring 31 moves overcentre.

In the operative position of the guide frame 7 the ceramic guides 6 contact opposite end portions of light metal rod 10 to lift the rod until its centre contacts a fulcrum portion 11 of a top span 12 of the guard frame 3 connecting the two side guards 4. The ends of the rod 10 are freely slidable in elongated blind recesses 13 in the front nib portions 5 of the side guards 4 so that the rod 10 is free-floating and freely pivotable about the fulcrum portion 11.

The top detector is adapted to be mounted on the frame of a knitting machine or on a creel as desired by means of a spring clip 14 which also acts as an earth for the lamp of the detector.

Equally good contact is made between the two ceramic guides 6 and the rod 10 as any distortion or misalignment of the guide frame 7 is fully compensated by a corresponding pivotal movement of the rod 10. Thus yarn is prevented from passing between the ceramic guides 6 and the rod 10 whether the yarn movement is from right to left as viewed in FIG. 2 or from left to right.

I claim:

1. A yarn fault detector for textile machinery that is provided with stopmotion circuitry, comprising a housing, detector wire means pivotally mounted on said housing and movable under gravity between a raised position supportable by a yarn in normal use, and a lower position effective to actuate the stopmotion circuitry on the textile machinery, a pivotal guide frame pivotally mounted on said housing and movable over center between an opertive yarn guiding position and a yarn releasing position, means within said housing biasing said guide frame to its yarn guiding or releasing positions, a pair of yarn guides on said guide frame, a fixed guard frame having side guards, one at each side of said pair of yarn guides, extending from said guide frame for further guiding yarn through the detector, and a freely pivotable stop bar on said fixed guard frame for contacting both of said yarn guides when said guide frame is in its operative position.

2. A yarn fault detector according to claim 1, wherein the pivotal axis of said stop bar is mid-way between the points of contact of stop bar and yarn guides.

3. A yarn fault detector according to claim 1 wherein said yarn guides are ceramic guides and said pivotable guide frame is a wire frame.

4. A yarn fault detector according to claim 1, wherein said stop bar is mounted with its ends freely slidable in slots in said fixed guard frame and an intermediate portion engageable with a fulcrum on said fixed guard frame when said pivotable guide frame is in its operative yarn guiding position.

5. A yarn fault detector according to claim 1, wherein said stop bar is mounted by a pivot pin intermediate its ends.

6. A yarn fault detector according to claim 1, wherein means are provided for varying the bias urging said guide frame to its yarn guiding or releasing position.

7. A yarn fault detector according to claim 6, wherein said means for varying the bias on the guide frame comprises a rotary shaft mounted in said housing, having extending therefrom a loop of flexible material connected via a spring to a cranked portion of a pivot shaft for the guide frame, rotation of said rotary shaft to wrap said flexible material thereon causing the bias on said guide frame to be increased.

8. A yarn fault detector according to claim 7, wherein said rotary shaft is rotatable by means of a knob splined thereto and removable axially therefrom.

9. A yarn fault detector according to claim 7, wherein said rotary shaft is made from a resilient plastics material and comprises an integral serrated disc the serrations of which are adapted in use to rise over a projection to give a resistance to turning.

10. A yarn fault detector for textile machinery, comprising a housing, detector wire means pivotally mounted on said housing, a pivotable guide frame pivotally mounted on said housing and movable overcentre between an operative yarn guiding position and a yarn releasing position, a one-piece moulding of a resilient plastics material having an integral loop portion and a shaft portion and being rotatably mounted within said housing, a control knob externally of said housing, associated with said one-piece moulding for effecting rotation thereof, a cranked portion of said guide frame internally of said housing, and resilient means between said cranked guide frame portion and said loop portion for biasing said guide frame towards its yarn guiding and releasing conditions with a bias that is dependent on the amount of said loop portion that is wrapped around said shaft portion.

11. A yarn fault detector according to claim 10, wherein said control knob is splined to said shaft portion and removable axially therefrom.

12. A yarn fault detector according to claim 10, wherein the integral loop is pre-stretched to reduce its tendency to creep.

13. A yarn fault detector according to claim 10, wherein said one-piece moulding is made from a resilient plastics material and comprises an integral serrated disc the serrations of which are adapted in use to ride over a projection to give a resistance to turning.

* * * * *

UNITED STATES PATENT AND TRADEMARK OFFICE

CERTIFICATE OF CORRECTION

PATENT NO. : 4,024,734

DATED : May 24, 1977

INVENTOR(S) : Kenneth Albert Jordan

It is certified that error appears in the above-identified patent and that said Letters Patent are hereby corrected as shown below:

Column 1, line 12, "would" should read -- wound --.

Column 1, line 14, "then" should read -- them --.

Column 1, line 38, "soley" should read -- solely --.

Column 2, lines 12-13, "mimi-mum" should read -- mini-mum --.

Column 2, line 24, "the" (first occurrence) should read -- an --

Column 2, line 27, "isa" should read -- is a --.

Column 4, line 22, "serration" should read -- serrations --.

Column 5, line 22 (claim 1, line 10), "opertive" should read -- operative --.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*